United States Patent [19]

Scorey et al.

[11] 4,373,970

[45] Feb. 15, 1983

[54] COPPER BASE SPINODAL ALLOY STRIP AND PROCESS FOR ITS PREPARATION

[75] Inventors: Clive R. Scorey; Roy A. Smith, both of Cheshire, Conn.

[73] Assignee: Pfizer Inc., New York, N.Y.

[21] Appl. No.: 321,341

[22] Filed: Nov. 13, 1981

[51] Int. Cl.[3] ..... C22F 1/08; B22F 3/16

[52] U.S. Cl. ..... 148/11.5 C; 148/11.5 P; 148/12.7 C; 148/400; 148/126.1; 419/23; 419/28; 419/37; 419/53; 419/57

[58] Field of Search ..... 148/11.5 P, 11.5 C, 148/12.7 C, 126, 32; 75/200, 214, 227

[56] References Cited

U.S. PATENT DOCUMENTS 4,012,240 3/1977 Hinrichsen ..... 148/11.5 C 4,110,130 8/1978 Nadkarni ..... 148/11.5 P 4,142,918 3/1979 Plewes ..... 148/11.5 C

*Primary Examiner*—W. Stallard

*Attorney, Agent, or Firm*—Charles J. Knuth; Peter C. Richardson; Harold W. Ordway

[57] ABSTRACT

Copper base spinodal alloy strip of good strength and ductility is provided, the alloy containing 5 to 35 percent nickel, 7 to 13 percent tin, balance essentially copper, and having an unaged microstructure characterized by an equiaxed grain structure of substantially all alpha, face-centered-cubic phase with a substantially uniform dispersed concentration of tin and a substantial absence of tin segregation. The strip is prepared from copper alloy powder of the indicated composition by a process comprising the steps of compaction, sintering, cooling, rolling and annealing. The strip after aging may contain up to about 50 percent alpha plus gamma phase.

34 Claims, 2 Drawing Figures

COPPER BASE SPINODAL ALLOY STRIP AND PROCESS FOR ITS PREPARATION

BACKGROUND OF THE INVENTION

The present invention relates to improved copper base spinodal alloys which are characterized by good strength properties as well as good ductility and to an improved process for their preparation from powder.

Copper, nickel and tin spinodal alloys have received significant attention in recent years as a potential substitute for copper-beryllium and phosphorbronze alloys in applications which require good electrical conductivity in combination with good mechanical strength and ductility. Heretofore, the major thrust of commercial production of coppeer base spinodal alloys has been through conventional wrought processing. Typical wrought processing is disclosed in U.S. Pat. Nos. 3,937,638, 4,052,204, 4,090,890 and 4,260,432, all in the name of J. T. Plewes. The processing involves preparing a copper-nickel-tin melt of desired composition and casting the melt into an ingot by conventional gravity type casting techniques such as DC casting and Durville casting. The cast ingot is then homogenized and thereafter cold worked in an attempt to break up the cored structure which results during the casting. The material is then worked to final dimensions, annealed, quenched and aged, generally with cold working between the quenching and aging. Attention is directed to U.S. Pat. No. 3,937,638 which describes the foregoing processing in detail.

While copper base spinodal alloys have been successfully prepared on a laboratory scale by the processing outlined above, the process has never proved to be commercially viable for a number of reasons. As a result of the conventional casting technique employed, the final product is characterized by tin segregation, generally at the grain boundaries, which has a detrimental effect on its strength and ductility. This tin segregation is directly attributable to the coring which occurs during casting. While a degree of the tin segregation can be eliminated by cold working, annealing and quenching the as-cast material, these operations increase the overall cost of the final product to the point of making the material noncompetitive with those materials it is intended to replace.

A roll-compacted copper-nickel-tin alloy prepared from a powdered mixture of the three metals is described by V. K. Sorokin in *Metalloved. Term. Obrab. Met.*, No. 5, pages 59–60 (1978). The product from the disclosed process, however, possesses only moderate strength and poor ductility.

It is naturally high desirable to provide copper base spinodal alloys characterized by good strength properties in combination with good ductility which are convenient to process and may be made economically on a commercial scale.

Accordingly, it is a primary object of the present invention to obtain such alloys and to provide such a process for their preparation.

It is a further object of the present invention to provide a process as aforesaid for obtaining copper base spinodal alloys characterized by a microstructure which is substantially free of tin segregation.

Further objects and advantages of the present invention will appear hereinbelow.

SUMMARY OF THE INVENTION

The copper base alloys processed in accordance with the present invention contain from about 5 to 35 percent nickel and from about 7 to 13 percent tin with the balance copper. Preferably, the alloys contain from about 8 to 11 percent tin, and especially preferred are such alloys with a nickel content of from about 5 to 25 percent. Naturally, optional additives may be included as desired, for example, additives selected from the group consisting of iron, magnesium, manganese, molybdenum, niobium, tantalum, vanadium and mixtures thereof may readily be added in small amounts. The foregoing alloys are processed by powder rolling techniques to produce copper-nickel-tin strip of the spinodal type. The process comprises blending powders of controlled particle size and shape suitable for roll compaction; compacting the powder to form a green strip having structural integrity and sufficient porosity to be penetrated by a reducing atmosphere; sintering the green strip in the reducing atmosphere to form a metallurgical bond, preferably at a temperature of from about 1200° to 1900° F. (649° to 1038° C.) for at least about one minute; cooling the sintered strip at a rate sufficient to prevent age hardening and embrittlement; rolling the cooled sintered strip to final gage, preferably by cold rolling; and finally annealing and quenching the rolled strip at a rate sufficient to retain substantially all alpha phase such that upon spinodal decomposition maximum hardening is obtained.

The microstructure of the unaged alloy produced in accordance with the process of the present invention is characterized by an equiaxed grain structure of substantially all alpha phase having a substantially uniform dispersed concentration of tin with substantial absence of tin segregation and a substantial absence of precipitation in the grain boundaries. The strip after aging may contain up to about 50 percent alpha plus gamma phase.

The process of the present invention may be utilized on a commercial scale and is characterized by a relatively moderate cost. In addition, the resultant alloy strip has superior combinations of strength and bend properties.

DETAILED DESCRIPTION OF THE INVENTION

Figure 1:
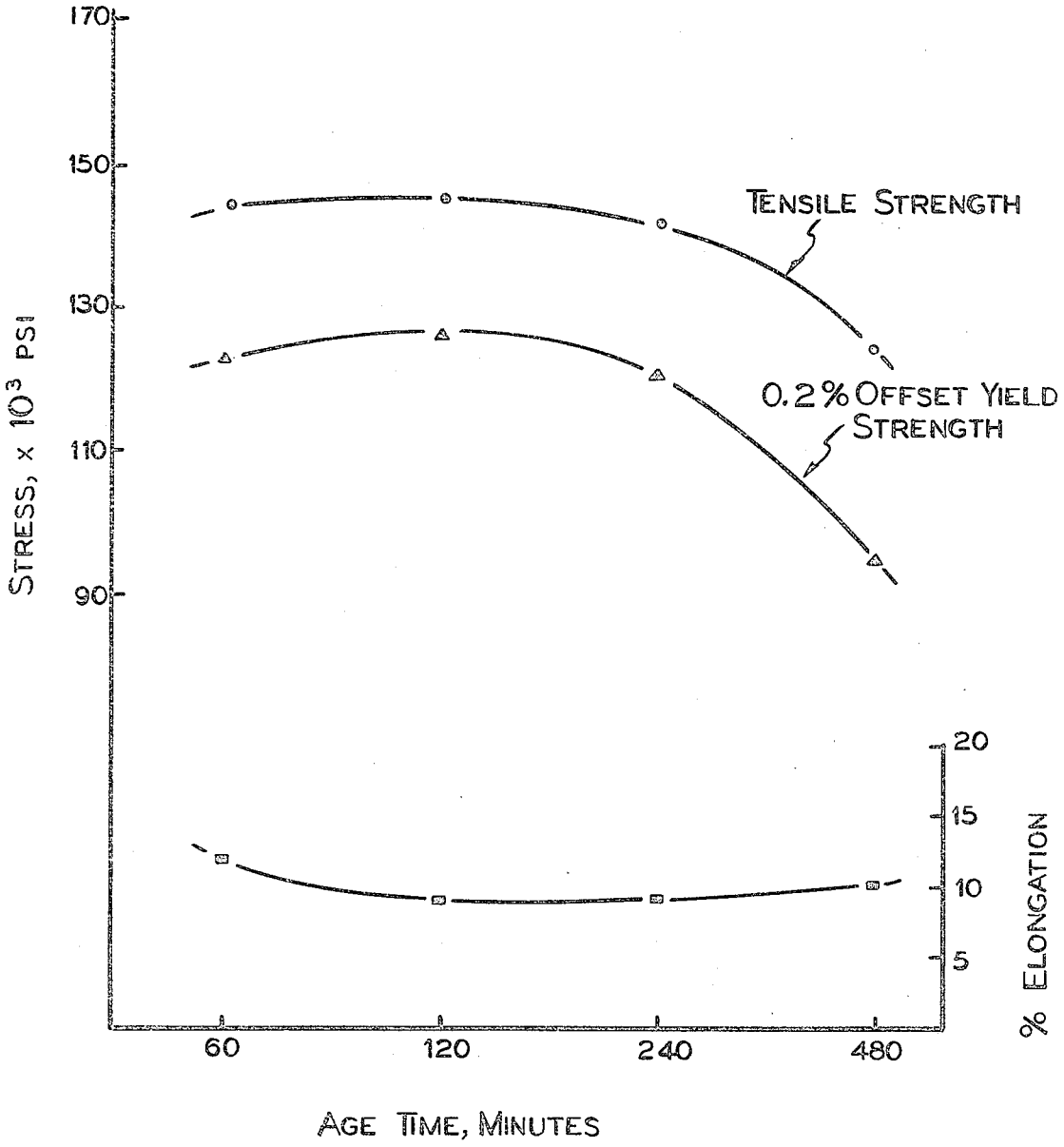
FIG. 1 is a graph of yield and tensile strength and percent elongation of the material of the present invention versus aging time in minutes at an aging temperature of 750° F. (399° C.).

The novel process of the present invention is applicable to the production of finished strip, by which term is included bars, rod and wire as well as ribbon, band, plate and sheet material and it is particularly useful in the production of strip in thicknesses of from about 0.0005 to 0.25 inch (0.013 to 6.4 millimeters).

As indicated hereinabove, the copper base spinodal alloys processed in accordance with the present invention contain from about 5 to 35 percent nickel and from about 7 to 13 percent tin. Compositions for particular applications include the higher nickel contents of such as 20 to 35 percent for higher elastic modulus and tin contents of such as 8 to 11 percent for higher strength.

Especially preferred for the present purpose are compositions containing from about 8 to 11 percent tin and from about 5 to 25 percent nickel. Naturally, one will select particular compositions and processing for the properties desired. For example, the rate of the age hardening reaction will be influenced by the aging temperature and the particular compositions.

In addition to the foregoing, the copper base alloys may contain optional additives as desired to accentuate particular properties, provided that the additives do not materially degrade the desirable properties obtained in accordance with the present invention. Particularly desirable additives include elements selected from the group consisting of iron, magnesium, manganese, molybdenum, niobium, tantalum, vanadium and mixtures thereof, each generally in amounts of from about 0.02 to 0.5 percent, not to exceed a total of about 2 percent. Small amounts of other additives such as aluminum, chromium, silicon, zinc and zirconium may of course be employed if desired. The presence of the additional elements may have the beneficial effect of further increasing the strength of the resulting copper base alloy as well as accentuating particularly desired characteristics. Amounts of the foregoing additional elements in excess of those set forth above are less desirable since they tend to impair the ductility of the final strip product.

The balance of the alloy of the present invention is essentially copper. Conventional impurities may be tolerated in small amounts but preferably are kept to a minimum. The oxygen and carbon contents in the sintered strip of the process should be kept to less than about 100 ppm each and preferably substantially zero; the presence of larger amounts of oxygen and carbon results in the formation of inclusions and other physical strip defects such as blisters, all of which are detrimental to the mechanical properties of the final strip product. Naturally, the oxygen and carbon contents in the starting powder are therefore kept as low as possible to implement the foregoing.

In accordance with the process of the present invention, the desired alloy composition is obtained by either blending elemental powders or atomizing a prealloyed melt, or both. When using elemental powders, the powders should be well blended to insure homogeneity of the powder blend. In order to obtain the desired powder properties upon roll compaction, these properties being apparent density, flow and green strength, the particle size of the powder should be in the range of from about 1 to 300 microns for at least about 90 percent of the powder mixture. In addition, in order to obtain proper flow characteristics, a binding agent which will volatilize during subsequent processing is preferably added to the powder mixture. Suitable binding agents are well known in the art and include, for example, long chain fatty acids such as stearic acid, cellulose derivatives, organic colloids, salicylic acid, camphor, paraffin and kerosene. Preferably, the binding agent is present in the powder mixture in an amount of up to about 1 percent.

In the preferred embodiment of the present invention, the powder is produced and blended by atomizing a prealloyed melt. Atomization involves breaking up the strea of molten metal alloy by means of gases or water. The present process preferably uses water for atomizing the molten metal so that the resultant particulate material has an irregular shape which is beneficial for obtaining the appropriate green strip strength during compaction; atomization with gases is less desirable since it produces substantially spherical particles. As is the case with mixing elemental powders for obtaining the proper properties in the rolled green strip, the particle size of the powder should be in the appropriate range, the range for the atomized powder being from about 20 to 300 microns for at least about 90 percent of the powder mixture. If the particle size exceeds 300 microns, there is a potential problem with segregation during subsequent processing. As with mixing elemental powders, small additions of binding agents are preferably added to the resulting atomized powder mixture in amounts up to about 1 percent; these binding agents include but are not limited to those listed above.

Because of the fine particle size of the powders employed in the process of the present invention, as well as the processing of the present invention, the segregation and coring that occurs during conventional gravity type casting, particularly with alloys containing tin, is eliminated. The uniform chemistry of the powders and the substantial absence of tin segregation materially adds to the inherent superior strength present in the final strip product when processing spinodal alloys in accordance with the present invention. Indeed, the present invention results in a surprising improvement in properties, as will be apparent from the examples which form a part of this specification.

After the production and blending of the powders as outlined above, the mixed high purity powders are fed, preferably in a continuous manner, into a rolling mill where the powders are compacted to cause a mechanical bond between the adjacent particles. The emerging strip is referred to as a green compact strip. The compaction loads and roll speeds are chosen so as to insure a strip density of the green strip which is about 70 to 95 percent of the theoretical density of the strip. The resultant density of the green strip is significant in the process of the present invention; a density of less than about 70 percent of the theoretical density results in a strip which has insufficient strength to withstand further processing, while a density greater than about 95 percent of the theoretical desnity results in a strip which is not sufficiently porous to allow the reducing atmosphere in the subsequent sintering step to penetrate the strip and insure a reduction of the oxygen content therein. In addition, if the density of the green strip exceeds 95 percent of the theoretical density, the strip tends to expand rather than to contract and become more dense during the subsequent sintering step. In accordance with the process of the present invention, the powder is normally compacted to at least about twice its original uncompacted apparent density. The preferred thickness of the green strip of the present invention is in the range of from about 0.025 to 1 inch (0.6 to 25 mm), particularly from about 0.025 to 0.5 inch (0.6 to 13 mm).

Following roll compaction, the next step in the process of the present invention is the sintering of the green strip in a reducing atmosphere to form a metallurgical bond. The strip may be either coil sintered or strip sintered in an inline operation. The sintering operation functions to (1) remove internal oxides from the green strip prior to densification thereof; (2) increase the strength of the strip; (3) decrease porosity and increase density of the compacted strip; (4) enable quenching so as to prevent age hardening and therefore a loss of ductility, which results in embrittlement of the strip; (5) remove any binding agent; and (6) achieve enhanced homogeneity. During the sintering step, solid state diffusion occurs which results in a metallurgical bond. In order to obtain the desired properties and achieve the foregoing objectives, the temperature and time of sintering the strip is significant. In accordance with the preferred embodiment of the present process, strip sintering is employed for processing and cost related reasons, the sintering preferably occurring at the highest possible temperature for the shortest amount of time. Thus, the strip is preferably heated as close to the solidus temperature of the alloy as possible without forming a liquid phase. The formation of a liquid phase during the sintering of the strip would be detrimental to the final product in that tin segregation would occur, resulting in an enriched tin phase, especially in the grain boundaries. Preferably, sintering occurs at a temperature of from about 1200° to 1900° F. (649° to 1038° C.) for a period of at least about one minute. The preferred sintering temperature is from about 1550° to 1770° F. (843° to 966° C.), and the preferred time is from about 1 to 30 minutes, optimally from about 5 to 15 minutes, per pass. Extensive sintering times of up to 50 hours or more are certainly feasible, and may be needed when elemental powders are used; however, normally there is insufficient justification for these extensive treatment times when prealloyed powders are employed. When strip is sintered in accordance with the preferred embodiment of the present invention, either a single pass or a plurality of passes through the furnace are required depending on the length of the furnace, the strip speed and the temperature; for example, 1 to 5 passes and preferably 3 passes are used. In order to maintain sufficiently low oxygen levels, to remove internal oxides and to insure further cleanup of the strip, the sintering operation takes place under a reducing atmosphere in the heating furnace. Conventional reducing atmospheres may be employed, such as pure hydrogen or disassociated ammonia or mixtures thereof, or a mixture of 10 percent hydrogen or carbon monoxide in nitrogen.

As previously noted, it is preferred in the process of the present invention that the strip be strip sintered. However, it is possible to coil sinter the strip to achieve the same purposes set out above for strip sintering. Coil sintering, however, should not take placed near the solidus temperature, since under such condition there is a tendency for the strip to stick together. Generally, coil sintering will be at a temperature at least about 100° F. (56° C.) below the solidus.

As noted above, the cooling of the sintered strip is critical in the process of the present invention. The strip must be cooled in such a manner as to avoid age hardening and thereby prevent loss of ductility and consequent embrittlement of the strip. It has been found in accordance with the process of the present invention that in order to prevent embrittlement of the strip, the strip should be rapidly cooled to below the age hardening temperature range of the alloy at a rate of at least about 200° F. (111° C.) per minute or, alternatively, very slowly cooled to below the age hardening temperature range under controlled conditions at a rate of no greater than 3° F. (1.7° C.) per minute. Naturally, rapid cooling is preferred. In the case of strip sintered strip, it is preferred that the strip emerging from the sintering furnace pass through a forced atmosphere cooling zone so as to rapidly cool the strip at the desired rate and thereby eliminate any hardening of the strip. In the case of strip which has been coil sintered, the strip should be carefully cooled at the very slow rate noted above to eliminate any possibility of age hardening with consequent embrittlement and loss of ductility.

The processing of the strip from powder particles as outlined above avoids the typical surface imperfections which occur from the mold as well as from the scale and oxides formed on conventional cast and rolled copper alloys in the slab heating furnaces, such defects requiring removal by machining operations which materially increase the overall processing costs. The surface characteristics of the strip prepared from powder are excellent, the rolled and sintered strip being ideally suited for further cold rolling and annealing.

Following the sintering step, the strip is processed to final gage. The strip may be either cold rolled with intermediate anneals as necessary or hot rolled to final gage. Generally, the strip is cold rolled to final gage in two or more steps with a reduction in the thickness of the strip of from about 30 to 70 percent, preferably about 50 percent, per step. The intermediate anneal provided between the cold rolling steps occurs at a temperature between the alpha phase boundary for the particular alloy being processed, which would be about 1470° F. (799° C.) for an alloy containing 15 percent nickel and 8 percent tin, and the solidus of the alloy, preferably from about 1500° to 1650° F. (816° to 899° C.), for at least about 15 seconds, preferably from about 15 seconds to 15 minutes, and optimally from about 1 to 5 minutes. The strip should be rapidly cooled following intermediate anneal in a manner as set out above for the cooling of sintered strip.

Subsequent to cold rolling to final gage, the strip is subjected to a final or solution anneal which is critical to the process of the present invention. Preferably, as with the intermediate anneals, the strip is heated to a temperature of from about 1500° to 1650° F. (816° to 899° C.), for at least about 15 seconds, preferably from about 15 seconds to 15 minutes and optimally from about 1 to 5 minutes, and thereafter is rapidly cooled at a rate of at least about 100° F. (56° C.) per second to retain a substantially pure alpha phase, such that maximum hardening occurs upon spinodal decomposition.

At this stage of the process, the annealed and quenched strip surprisingly generally exhibits an elongation of at least 20 percent, giving formability and workability in the fully dense annealed and quenched condition. Increased strength can be achieved at this stage after the final anneal but before age hardening, if desired, by cold working to roll temper with reduction of up to about 40 percent in the strip thickness. Some loss of ductility is entailed, however.

The strip may then be age hardened at a temperature of from about 500° to 1000° F. (260° to 538° C.) for at least about 15 seconds and generally for from about 1 to 10 hours so as to yield an alloy having the desired strength and ductility. Naturally, the exact age hardening conditions depend on the desired property level. The age hardening step may be performed in the mill or subsequently, prior to the final application.

The microstructure of the unaged alloy processed in accordance with the process of the present invention is characterized by an equiaxed grain structure which is substantially all alpha, face-centered-cubic phase having a substantially uniform dispersed concentration of tin and a substantial absence of the detrimental tin segregation, but which may contain a small amount of gamma phase. In addition, the microstructure of the unaged alloy is characterized by the substantial absence of grain boundary precipitation, for example, the absence of alpha plus gamma precipitation at the grain boundaries. Such phases are described, for example, by E. G. Baburaj et al in *J. Appl, Cryst.*, Vol. 12, pages 476–80 (1979) and B. G. LeFevre et al in Met. Trans., Vol. 9A, page 577 (April 1978). Grain boundary precipitation tends to occur upon extended aging. However, good properties are obtained despite the fact that as much as about 50 percent alpha plus gamma precipitates out upon aging as long as the alloy is substantially all alpha phase prior to aging. With the present process as described hereinabove involving the production of copper base spinodal alloy strip by poweder metallurgy, surprisingly superior strength properties are achieved in combination with good ductility after aging. These superior properties are directly attributable to the microstructure of the alloy so produced which exhibits a uniformly dispersed concentration of tin throughout the grain structure with substantially no tin segregation before aging.

The present invention and improvements resulting therefrom will be more readily apparent from a consideration of the following illustrative example.

EXAMPLE

Copper base alloy strip having a thickness of 0.012 inch (0.3 mm) and a composition of about 15 weight percent nickel, 8 weight percent tin and the balance essentially copper was prepared in accordance with the present invention from powder in the following manner. The powder was prepared by atomizing a stream of a prealloyed melt of this composition with water to obtain irregular shaped particles. The particles thus produced were thoroughly blended together with about 0.2 weight percent kerosene binding agent, using powder having a particle size in the range of 20 to 300 microns for 90 percent of the total powder mixture.

The powder-binder mixture walls roll compacted at an appropriate rolling speed and roll pressure to obtain a green strip having a density about 80 percent of the theoretical density and a thickness of about 0.110 inch (2.8 mm). Following roll compaction, the green bonded strip was sintered in a reducing atmosphere of hydrogen by strip sintering at a temperature of about 1800° F. (982° C.) using four passes of about 10 minutes per pass and a fifth pass of about 5 minutes followed by rapid cooling to room temperature at a rate of 250° F. (139° C.) per minute using a forced atmosphere cooling zone on the strip as it emerged from the sintering furnace.

Following the sintering step, the strip was processed to a final gage of 0.012 inch (0.3 mm) by cold rolling and annealing in four steps with intermediate strip anneals at about 1600° F. (871° C.) for about 5 minutes furnace time between steps, the strip being cooled to room temperature following each intermediate anneal at a rate of 50° F. (28° C.) per second. The strip was given a final or solution anneal at 1600° F. (871° C.) for about 5 minutes followed by rapid cooling to room temperature at a rate of 200° F. (111° C.) per second to result in a material exhibiting 43 percent elongation. Age hardening at 750° F. (399° C.) for 120 minutes resulted in a strip characterized by unusually high strength and good ductility, as can be seen from Table I (Alloy 1). In a similar manner, additional alloy strips were produced and then age hardened as indicated in Table I, the resultant strips again exhibiting high strength and ductility.

For comparative purposes, Table II shows properties of an alloy having the same composition but prepared by conventional wrought processing as reported in U.S. Pat. No. 4,260,432. The improvement in properties in accordance with the process and product of the present invention is quite surprising.

TABLE I

| Alloy Number | Aging Temp., °F. | Aging Time, Min. | Ultimate Tensile Strength, psi | 0.2% Yield Strength, psi | Percent Elongation, in 2 inches |
|---|---|---|---|---|---|
| 1 | 750 | 120 | 142,000 | 124,000 | 7.0 |
| 2 | 750 | 120 | 144,000 | 128,000 | 6.0 |
| 3[a] | 750 | 120 | 145,500 | 125,000 | 9.0 |
| 4 | 800 | 30 | 141,000 | 128,000 | 5.5 |
| 5 | 800 | 60 | 146,000 | 136,000 | 2.5 |
| 6 | 750 | 240 | 143,000 | 130,000 | 2.0 |
| 7 | 750 | 60 | 141,000 | 126,000 | 5.7 |

[a]sintered by 2 passes of strip sintering followed by coil sintering for 48 hours at about 1600°F. (871°C.)

TABLE II

| Alloy Number | Aging Temp., °F. | Aging Time, Min. | Ultimate Tensile Strength, psi | 0.01% Yield Strength | Percent Elongation |
|---|---|---|---|---|---|
| 8 | 752 | 30 | 120,000 | 87,000 | 1.7 |
| 9 | 752 | 120 | 104,000 | 104,000 | 0.02 |

FIG. 1, which forms a part of the present specification, shows the yield and tensile strength and percent elongation versus aging time at an aging temperature of 750° F (399° C.) and vividly illustrates the remarkable properties obtained in accordance with the present invention.

Figure 2:
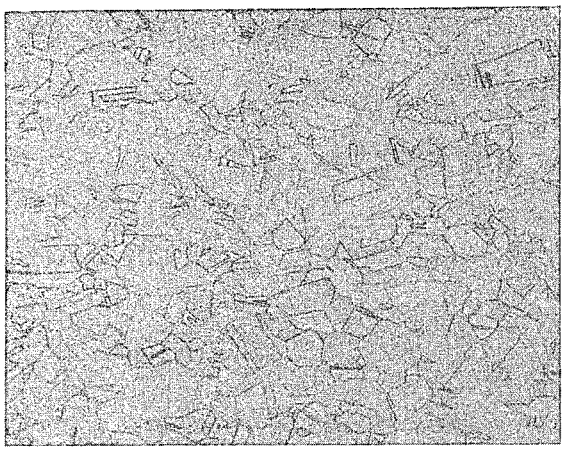
FIG. 2 is a photomicrograph of the material of the present invention at a magnification of 250X showing the material in the annealed and quenched condition.

The microstructure of the strips of the present invention (Alloys 1-7) were examined before aging and were characterized by an equiaxed grain structure of substantially all alpha, face-centered-cubic phase having a substantially uniform dispersed concentration of tin and a substantial absence of the detrimental tin segregation. FIG. 2 shows a photomicrograph of Alloy 7 in the solution annealed and quenched condition at a magnification of 250X. The photomicrograph clearly shows the aforesaid microstructure.

This invention may be embodied in other forms or carried out in other ways without departing from the spirit or essential characteristics thereof. The present embodiment is therefore to be considered in all respects as illustrative and not restrictive, the scope of the invention being indicated by the appended claims.

We claim:

1. A process for preparing copper base spinodal alloy strip having good strength properties in combination with good ductility, which comprises:
   (a) providing a copper base alloy powder containing from about 5 to 35 percent nickel, from about 7 to 13 percent tin, balance copper;
   (b) compacting the alloy powder to form a green strip having structural integrity and sufficient porosity to be penetrated by a reducing atmosphere;
   (c) sintering the green strip in the reducing atmosphere to form a metallurgical bond; (d) cooling the sintered strip at a rate to prevent agen hardening and embrittlement; (e) rolling the cooled sintered strip to substantially fully dense final gage; and (f) finally annealing the rolled strip and quenching it at a rate sufficient to retain substantially all alpha phase.

2. A process according to claim 1 wherein the alloy powder is obtained by blending elemental powders.

3. A process according to claim 1 wherein the alloy powder is obtained by atomizing a prealloyed melt.

4. A process according to claim 1 wherein at least about 90 percent of the alloy powder has a particle size in the range of from about 1 to 300 microns.

5. A process according to claim 1 wherein the alloy powder contains up to about 1 percent of a binding agent which volatilizes during processing.

6. A process according to claim 3 wherein the atomizing is water atomization which produces irregular shaped particles.

7. A process according to claim 1 wherein the alloy powder is compacted to green strip having a thickness of from about 0.025 to 1 inch.

8. A process according to claim 1 wherein the alloy powder is compacted to at least about twice its original uncompacted density.

9. A process according to claim 1 wherein the density of the green strip is from about 70 to 95 percent of the theoretical density of the strip.

10. A process according to claim 1 wherein the sintering is at a temperature of from about 1200° to 1900° F. for at least about one minute.

11. A process according to claim 1 wherein the sintering is strip sintering using from 1 to 5 passes.

12. A process according to claim 11 wherein the sintering is at a temperature of from about 1550° to 1700° F. for from about 1 to 30 minutes per pass.

13. A process according to claim 1 wherein the sintered strip is cooled to below the age hardening temperature range of the alloy at a rate of at least about 200° F. per minute.

14. A process according to claim 1 wherein the oxygen and carbon contents of the sintered strip are each kept to less than about 100 ppm.

15. A process according to claim 1 wherein the cooled sintered strip is cold rolled to final gage in at least 2 steps with intermediate anneal between the steps at a temperature between the alpha phase boundary and the solidus temperature of the alloy for at least about 15 seconds.

16. A process according to claim 15 wherein the alloy strip is rapidly cooled following the intermediate anneal.

17. A process according to claim 15 wherein the cold rolling results in a reduction of from about 30 to 70 percent per step.

18. A process according to claim 1 wherein the final anneal is at a temperature of from about 1500° to 1650° F. for at least about 15 seconds followed by cooling at a rate of at least about 100° F. per second to retain substantially all alpha phase.

19. A process according to claim 1 wherein the alloy strip is age hardened following the final anneal.

20. A process according to claim 19 wherein the age hardening is at a temperature of from about 500° to 1000° F. for at least about 15 seconds.

21. A process according to claim 19 wherein the alloy strip is cold worked up to about 40 percent after the final anneal but before the age hardening.

22. A process according to claim 1 wherein the annealed strip is characterized by an equiaxed grain structure of substantially all alpha, face-centered-cubic phase having a substantially uniform dispersed concentration of tin and a substantial absence of tin segregation.

23. A process according to claim 1 wherein the annealed strip is characterized by the substantial absence of grain boundary precipitation.

24. A copper base spinodal alloy strip having good strength properties in combination with good ductility, which comprises a copper base alloy containing from about 5 to 35 percent nickel, from about 7 to 13 percent tin, the balance essentially copper, the alloy having an unaged microstructure characterized by an equiaxed grain structure of substantially all alpha, face-centered-cubic phase with a substantially uniform dispersed concentration of tin and a substantial absence of tin segregation.

25. A strip according to claim 24 wherein the microstructure is further characterized by a substantial absence of grain boundary precipitation.

26. A strip according to claim 24 wherein the tin content is from about 8 to 11 percent.

27. A strip according to claim 26 wherein the nickel content is from about 5 to 25 percent.

28. A strip according to claim 24 in a cold worked temper.

29. A strip according to claim 24 in an annealed temper.

30. A strip according to claim 24 in an anged condition wherein the microstructure contains up to about 50 percent alpha plus gamma phase.

31. A strip according to claim 24 prepared from copper base alloy powder.

32. A process for preparing copper base spinodal alloy strip having good strength properties in combination with good ductility and characterized by an equiaxed grain structure of substantially all alpha, face-centered-cubic phase having a substantially uniform dispersed concentration of tin and a substantial absence of tin segregation and by the substantial absence of grain bounary precipitation, which comprises:

(a) providing a copper base alloy powder containing from about 5 to 35 percent nickel, from about 7 to 13 percent tin, balance copper, with at least about 90 percent of the alloy powder having a particle size in the range of from about 1 to 300 microns;

(b) compacting the alloy powder to form a green strip having structural integrity and sufficient porosity to be penetrated by a reducing atmosphere, with the density of said green strip being from about 70 to 95 percent of the theoretical density of the strip;

(c) sintering the green strip in the reducing atmosphere at a temperature of from about 1200° to 1900° F. for at least about one minute to form a metallurgical bond;

(d) cooling the sintered strip to below the age hardening temperature range of the alloy at a rate of at last about 200° F. per minute to prevent age hardening and embrittlement;

(e) cold rolling the cooled sintered strip to substantially full dense final gage in at least two steps with intermediate anneal between the steps at a temperature between the alpha phase boundary and the solidus temperature of the alloy for at least about 15 seconds, with said cold rolling resulting in a reduction of from about 30 to 70 percent per step and with the alloy strip being rapidly cooled following the intermediate anneal; and (f) finally annealing the rolled strip at a temperature of from about 1500° to 1650° F. for at least about 15 seconds followed by cooling at a rate of at least about 100° F. per second to retain substantially all alpha phase.

33. The copper base spinodal alloy strip prepared in accordance with the process of claim 1.

34. The copper base spinodal alloy strip prepared in accordance with the process of claim 32.

* * * * *